US012247473B1

(12) United States Patent
Taha et al.

(10) Patent No.: US 12,247,473 B1
(45) Date of Patent: Mar. 11, 2025

(54) ENERGY DISSIPATING FLOW BLOCK FOR HYDRAULIC FRACTURING

(71) Applicant: Saudi Arabian Oil Company, Dhahran (SA)

(72) Inventors: Syed Muhammad Bin Syed Taha, Dhahran (SA); Amr Mohammed Zahran, Al Khobar (SA); Abdullah Mohammed Khair Alkassab, Dhahran (SA); Wafaa Hassan Alnakhli, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/588,177

(22) Filed: Feb. 27, 2024

(51) Int. Cl.
*E21B 43/26* (2006.01)

(52) U.S. Cl.
CPC ..... *E21B 43/2607* (2020.05)

(58) Field of Classification Search
CPC ..... E21B 43/2607
See application file for complete search history.

(56) References Cited

U.S. PATENT DOCUMENTS 4,169,504 A * 10/1979 Scott ..... E21B 33/068 285/125.1
6,575,247 B2 * 6/2003 Tolman ..... E21B 43/26 166/305.1
8,786,113 B2 7/2014 Tinnen et al.
9,004,104 B2 * 4/2015 Ungchusri ..... F17D 1/08 141/387
9,127,535 B2 9/2015 Coyle et al.
10,086,385 B2 10/2018 Kvamsdal et al.
10,294,766 B2 * 5/2019 Saleh ..... F16L 41/02
10,876,376 B2 * 12/2020 Robinson ..... E21B 41/00
11,365,615 B2 6/2022 Yeung et al.
2016/0060997 A1 * 3/2016 Thomas ..... E21B 33/068 166/88.4
2017/0002620 A1 * 1/2017 Roesner ..... E21B 43/2607
2023/0085124 A1 3/2023 Zhong et al.

FOREIGN PATENT DOCUMENTS

WO 2016113391 A1 7/2016

* cited by examiner

*Primary Examiner* — Matthew R Buck
(74) *Attorney, Agent, or Firm* — Bracewell LLP; Constance G. Rhebergen; Eleanor T. Porter

(57) ABSTRACT

A method for reducing kinetic energy of an energized stimulation fluid upstream of a wellbore, the method comprising the steps of introducing the energized stimulation fluid to an energy dissipating flow block installed in a frac tree, the energy dissipating flow block comprises a body having an internal geometry configured to produce cyclonic flow of the energized stimulation fluid, the body comprising a top and a bottom; an inlet nozzle positioned proximate and parallel to the top of the body; a cushioning sub positioned parallel to the top of the body and opposite the inlet nozzle; and an outlet nozzle positioned perpendicular to the bottom of the body; reducing the kinetic energy of the energized stimulation fluid due to the cyclonic flow in the body; introducing the stimulation fluid to the frac tree; and introducing the stimulation fluid to the wellbore through the frac tree.

9 Claims, 2 Drawing Sheets

ENERGY DISSIPATING FLOW BLOCK FOR HYDRAULIC FRACTURING

TECHNICAL FIELD

Disclosed are systems and methods to control erosion during hydraulic fracturing stimulation treatment. Specifically, disclosed are systems and methods to control erosion by dissipating energy of the hydraulic fracturing stimulation treatment while maintaining velocity and pressure at the point of stimulation fluid introduction into the wellhead.

BACKGROUND

The evolution of hydraulic fracturing treatment has gravitated towards the delivery of more aggressive stimulation treatment to the formation to ensure the creation of greater levels of effective stimulated areas and conductivity. This is typically achieved through the delivery of stimulation at higher pumping rates. The challenge would be to deliver the higher pumping rates through existing well infrastructure while ensuring full well pressure containment throughout the entire stimulation delivery period. The biggest threat towards achieving full well containment throughout the high rate stimulation delivery would be the erosive effects of the stimulation treatment on the stimulation delivery equipment and wellhead itself.

SUMMARY

Disclosed are systems and methods to control erosion during hydraulic fracturing stimulation treatment. Specifically, disclosed are systems and methods to control erosion by dissipating energy of the hydraulic fracturing stimulation treatment while maintaining velocity and pressure at the point of stimulation fluid introduction into the wellhead.

In a first aspect, a method for reducing kinetic energy of an energized stimulation fluid upstream of a wellbore is provided. The method includes the steps of introducing the energized stimulation fluid to an energy dissipating flow block installed in a frac tree. The energy dissipating flow block includes a body, the body having an internal geometry configured to produce cyclonic flow of the energized stimulation fluid, the body includes a top and a body, an inlet nozzle, the inlet nozzle positioned proximate and parallel to the top of the body, the inlet nozzle is configured to receive the energized stimulation fluid, a cushioning sub, the cushioning sub positioned parallel to the top of the body and opposite the inlet nozzle, and an outlet nozzle, the outlet nozzle positioned perpendicular to the bottom of the body. The method further includes the steps of reducing the kinetic energy of the energized stimulation fluid in the energy dissipating flow block due to the cyclonic flow in the body to produce a stimulation fluid, introducing the stimulation fluid to a frac tree, the frac tree fluidly connected to the outlet nozzle of the energy dissipating flow block, and introducing the stimulation fluid to the wellbore through the frac tree.

In certain aspects, a fluid velocity of the stimulation fluid is reduced compared to the energized stimulation fluid. In certain aspects, a Reynolds number of the stimulation fluid is reduced compared to the energized stimulation fluid. In certain aspects, a flow rate of the stimulation fluid is the same as a flow rate of the energized stimulation fluid. In certain aspects, the cyclonic flow follows a cyclonic flow path trajectory in the body.

In a second aspect a device for reducing kinetic energy of an energized stimulation fluid upstream of a wellbore is provided. The device includes a body, the body having an internal geometry configured to produce cyclonic flow of the energized stimulation fluid, the body includes a top and a body, an inlet nozzle, the inlet nozzle positioned proximate and parallel to the top of the body, the inlet nozzle is configured to receive the energized stimulation fluid, a cushioning sub, the cushioning sub positioned parallel to the top of the body and opposite the inlet nozzle, and an outlet nozzle, the outlet nozzle positioned perpendicular to the bottom of the body.

In certain aspects, the internal geometry of the body is selected from the group consisting of a conical frustum, a pyramidal frustum, a polyhedron, and combinations of the same. In certain aspects, the device further includes monoflex hose fluidly connected to the inlet nozzle. In certain aspects, the inlet nozzle meets the requirements of API 6A. In certain aspects, the cushioning sub meets the requirements of API 6A. In certain aspects, the outlet nozzle meets the requirements of API 6A.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1A:
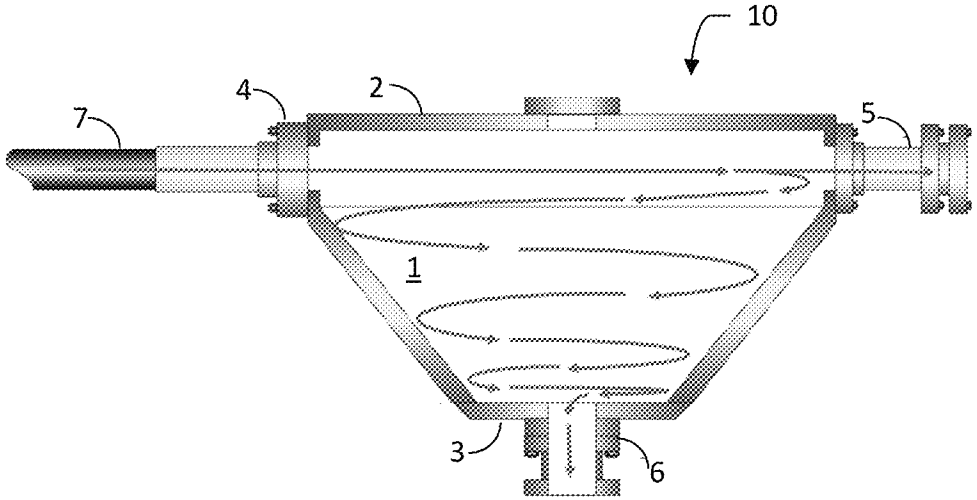
FIG. 1A is a front sectional view of an energy dissipating flow block showing the body, inlet nozzle, the cushioning sub, the outlet nozzle, and the flow path of the fluid.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

The systems and methods described aim to mitigate the threat of erosion by introducing a means to dissipate the energy of the stimulation treatment, while maintaining full delivery pressure, at the point of stimulation fluid introduction into the wellhead. The energy dissipating allows the stimulation fluid to maintain its velocity and pressure, while dissipating the energy that would contribute to erosion.

Advantageously and unexpectedly, this is achieved by subjecting the fluid path, through a pressure contained flow block, to an induced cyclonic flow direction, thereby increasing the flow travel distance within a limited and workable dimension. In addition, the fluid flow path is not subjected to sharp changes in flow path trajectory, thus eliminating abrupt energy transfer through a sharp increase in fluid turbulence level. Advantageously, the energy dissipated throughout the increased flow travel distance in a cyclonic trajectory effectively eliminates erosion and ensures pressure retention capability throughout the well stimulation cycle. Advantageously, the energy dissipating flow block provides a means for the optimum and efficient dissipating of energy at the point of stimulation fluid introduction into a wellhead. Advantageously, the energy dissipating flow block provides a means to direct the flow trajectory of the stimulation fluid into a cyclonic flow allowing for maximum fluid travel distance and eliminates abrupt flow trajectory changes. Advantageously, the energy dissipating flow block can be used in conjunction with permanently installed wellhead components. Advantageously, the energy dissipating flow block eliminates the threat of well pressure containment loss due to erosion, while maintaining the same permanently deployed wellhead components. Advantageously, the energy dissipating flow block can increase flow rate of the stimulation fluid without increasing the primary bore size, which would necessitate replacement of component parts on the frac tree.

As used throughout, "cyclonic flow" or "cyclonic flow path trajectory" refers to circular flow that travels along the walls in a spiral from the inlet to the outlet. Cyclonic flow exerts a centripetal force.

As used throughout, "frac tree" refers to a specific type of Christmas tree for use in hydraulic fracturing that typically consists of a number of different types of valves arranged so as to manage the flow rates and pressures necessary for hydraulic fracturing.

Referring to FIG. 1A a front sectional view of energy dissipating flow block 10. Energy dissipating flow block 10 includes body 1, inlet nozzle 4, cushioning sub 5, and outlet nozzle 6. Body 1 can have any internal geometry that produces cyclonic flow. The internal geometry of body 1 can include a conical frustum, a pyramidal frustum, a polyhedron, or combinations of the same. The maximum diameter of body 1 is between 20" and 120". In at least one embodiment, the maximum diameter of body 1 is 120". The vertical height of body 1 is between 20" and 120", and alternately between 60" and 120". Regardless of geometric shape, the diameter of body 1 is wider at top 2 and narrower at bottom 3. In at least one embodiment, the interior of body 1 can have a conical frustum shape that funnels the flow of the stimulation fluid down into main vertical flow path toward outlet nozzle 6. The exact geometry and size of body 1 can be selected based on the desired flow path travel distance and cyclonic flow trajectory, and API 6A material selection and manufacturing mandates. Body 1 is designed to withstand the centripetal force exerted by the cyclonic flow. The desired flow path travel distance and cyclonic flow trajectory may be determined based on the flow rate and pressure of the stimulation fluid in existing applications in applications where the energy dissipating flow block is to be used in existing wellheads or in anticipated future applications.

Inlet nozzle 4 can be any type of connection that meets the requirements of API 6A and promotes cyclonic flow. Inlet nozzle 4 is positioned proximate and parallel to top 2 of body 1 of energy dissipating flow block 10. Inlet nozzle 4 is asymmetrical or non-concentric to the centerline of body 1 of energy dissipating flow block 10. The positioning of inlet nozzle 4 induces cyclonic flow of the stimulation fluid. In at least one embodiment, inlet nozzle 4 is an eccentric inlet. Inlet nozzle 4 can include monoflex hose 7. Monoflex hose 7 connects energy dissipating flow block 10 to the surface frac circuit.

Cushioning sub 5 is positioned parallel to top 2 of body 1 of energy dissipating flow block 10 and across from inlet nozzle 4 in the shortest straight line distance. Cushioning sub 5 provides a damping effect to the energized stimulation fluid entering energy dissipating flow block 10. Fluids with limited compressibility, but with some measure of dampening, will occupy the cushioning sub that is strategically placed in the direct primary flowpath. The fluid will occupy the volume of the cushioning sub and provide the function of dampening any subsequent fluid entry into the body of the energy dissipating flow block. Because the fluid occupying the cushioning sub is unable to travel anywhere else its lack of compressibility will in turn act as a temporary baffle to redirect any subsequent fluid entering the body to follow a direction of travel governed by the geometric shape of the body. Cushioning sub 5 is any type of fitting that meets the API 6A standards.

Outlet nozzle 6 can be any type of connection the meets the requirements of API 6A. Outlet nozzle 6 is sized to connect to frac tree 8.

Figure 1B:
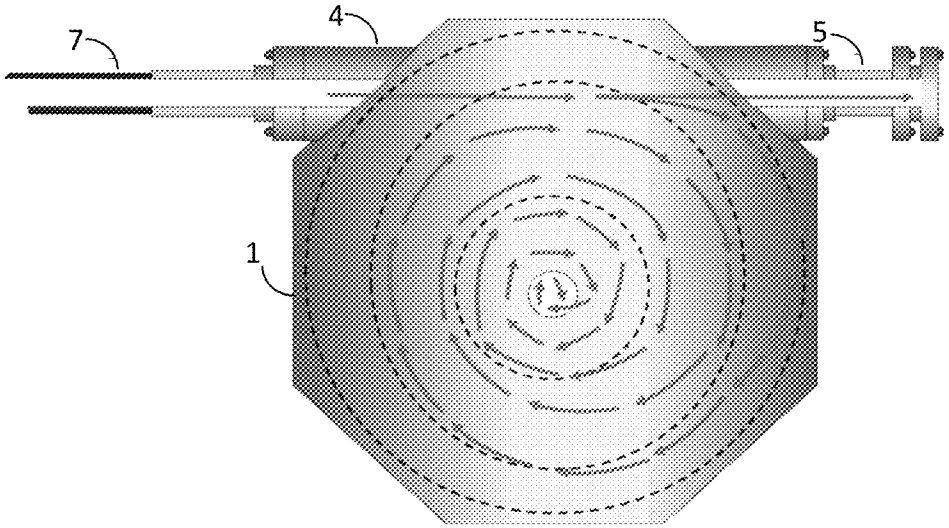
FIG. 1B is a top sectional view of an energy dissipating flow block showing the body, inlet, the cushioning sub, and the flow path of the fluid.
Figure 2A:
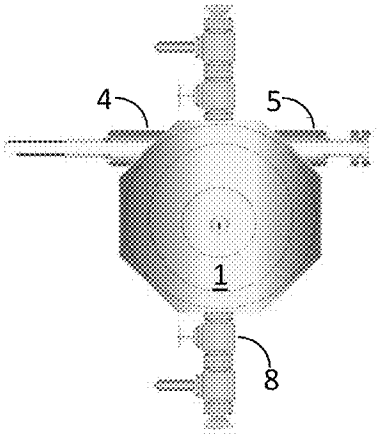
FIG. 2A is a top view of an energy dissipating flow block installed in wellhead system showing the body, inlet nozzle and the cushioning sub.
Figure 2B:
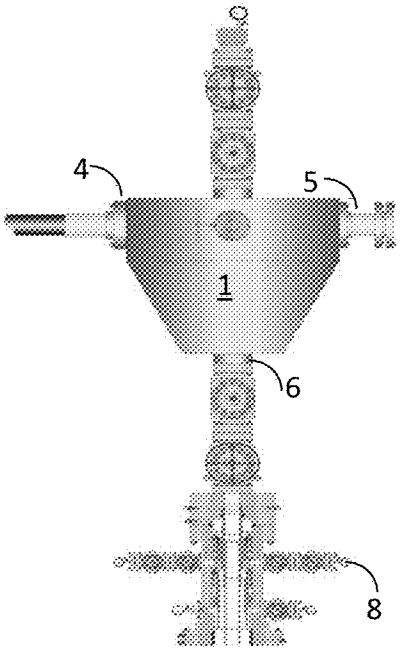
FIG. 2B is a front view of an energy dissipating flow block installed in wellhead system showing the body, inlet nozzle, the cushioning sub, and the outlet nozzle.
Figure 2C:
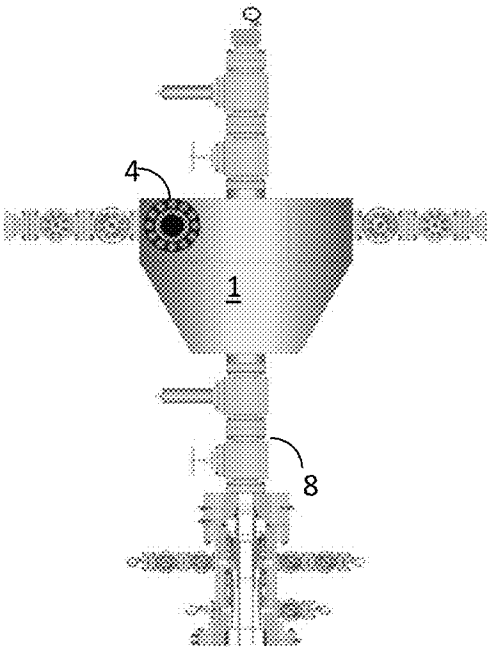
FIG. 2C is an end view of an energy dissipating flow block installed in wellhead system showing the body, inlet nozzle, the cushioning sub, and the outlet nozzle.

Referring to FIGS. 2A-2C with reference to FIGS. 1A-1B, energy dissipating flow block 10 can be installed in frac tree 8. Energized stimulation fluid enters inlet nozzle 4 of energy dissipating flow block 10 and is directed into a cyclonic flow path trajectory in body 1. The straight line equivalent distance the energized stimulation fluid travels depends on the size of energy dissipating flow block 10 and the amount of kinetic energy (pressure) that needs to be dissipated. The cyclonic flow path trajectory of the energized stimulation fluid in body 1 dissipates energy in the energized stimulation fluid. Dissipating the kinetic energy of the energized stimulation fluid reduces the fluid velocity of the energized stimulation fluid which reduces the Reynolds number. The reduced Reynolds number reduces the turbulence which can reduce the rate of erosion to a degree such that the well stimulation design can be delivered without risking the wellhead's pressure containment. Stimulation fluid exits energy dissipating flow block 10 through outlet nozzle 6 having reduced fluid velocity while retaining the same flow rate relative to the energized stimulation fluid. The stimulation fluid has reduced Reynolds number, reduced turbulence and will have reduced erosion rates compared to the energized stimulation fluid. The stimulation fluid enters the wellbore through frac tree 8.

Energy dissipating flow block 10 can be used for the entire duration of the well stimulation delivery cycle. The installation of energy dissipating flow block 1 can increase the flow rate of the stimulation fluid entering the wellbore by at least 5 vol %, alternately by at least 10 vol %, alternately by at least 15 vol %, alternately by at least 20 vol %, alternately by at least 25 vol %, and alternately by between 5 vol % and 25 vol % compared to a system without an energy dissipating flow block 10.

Increasing the flow rate of the stimulation fluid can achieve increased effective stimulation areas and greater well conductivity with the same installed equipment, which can increase operational efficiency.

The energy dissipating flow block as described is not a cyclonic separator or hydrocyclone separator. The energy dissipating flow block is in the absence of separation means.

Examples

According to a prophetic example, the inlet nozzle and cushioning sub would each be a 7 1/16"×15 M connection. The outlet nozzle would be a 5 1/8"×15 M connection. Each of these connections are API 6A compliant connections. The size of these connections are selected to fit an existing frac tree. Dimensions could enable increase in flow rate from 92 barrels per minute to 120 barrels per minute without loss of pressure containment.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

What is claimed is:

1. A method for reducing kinetic energy of an energized stimulation fluid upstream of a wellbore, the method comprising the steps of:

introducing the energized stimulation fluid to an energy dissipating flow block installed in a frac tree, the energy dissipating flow block comprises:

a body, the body having an internal geometry configured to produce cyclonic flow of the energized stimulation fluid, the body comprising a top and a bottom, where the diameter of the body is wider at the top and narrower at the bottom, where the internal geometry is selected from the group consisting of a conical frustum, a pyramidal frustum, a polyhedron, or combinations of the same, where the body is configured to withstand a centripetal force exerted by the cyclonic flow;

an inlet nozzle, the inlet nozzle positioned proximate and parallel to the top of the body, the inlet nozzle is configured to receive the energized stimulation fluid;

a cushioning sub, the cushioning sub positioned parallel to the top of the body and opposite the inlet nozzle; and an outlet nozzle, the outlet nozzle positioned perpendicular to the bottom of the body; reducing the kinetic energy of the energized stimulation fluid in the energy dissipating flow block due to the cyclonic flow in the body to produce a stimulation fluid, where the cyclonic flow follows a cyclonic flow path trajectory in the body such that the cyclonic flow travels along walls of the body in a spiral from the inlet nozzle to the outlet nozzle, where the cyclonic flow exerts the centripetal force;

introducing the stimulation fluid to the frac tree fluidly connected to the outlet nozzle of the energy dissipating flow block; and introducing the stimulation fluid to the wellbore through the frac tree.

2. The method of claim 1, wherein a fluid velocity of the stimulation fluid is reduced compared to the energized stimulation fluid.

3. The method of claim 1, wherein a Reynolds number of the stimulation fluid is reduced compared to the energized stimulation fluid.

4. The method of claim 1, wherein a flow rate of the stimulation fluid is the same as a flow rate of the energized stimulation fluid.

5. A device for reducing kinetic energy of an energized stimulation fluid upstream of a wellbore, the device comprising:

a body, the body having an internal geometry configured to produce cyclonic flow of the energized stimulation fluid, the body comprising a top and a bottom, where the diameter of the body is wider at the top and narrower at the bottom, where the internal geometry is selected from the group consisting of a conical frustum, a pyramidal frustum, a polyhedron, or combinations of the same, where the body is configured to withstand a centripetal force exerted by the cyclonic flow;

an inlet nozzle, the inlet nozzle positioned proximate and parallel to the top of the body, the inlet nozzle is configured to receive the energized stimulation fluid;

a cushioning sub, the cushioning sub positioned parallel to the top of the body and opposite the inlet nozzle; and an outlet nozzle, the outlet nozzle positioned perpendicular to the bottom of the body, where the cyclonic flow follows a cyclonic flow path trajectory in the body such that the cyclonic flow travels along walls of the body in a spiral from the inlet nozzle to the outlet nozzle, where the cyclonic flow exerts the centripetal force.

6. The device of claim 5, further comprising monoflex hose fluidly connected to the inlet nozzle.

7. The device of claim 5, wherein the inlet nozzle meets the requirements of API 6A.

8. The device of claim 5, wherein the cushioning sub meets the requirements of API 6A.

9. The device of claim 5, wherein the outlet nozzle meets the requirements of API 6A.

* * * * *